US010497316B2

(12) United States Patent
Wang et al.

(10) Patent No.: US 10,497,316 B2
(45) Date of Patent: Dec. 3, 2019

(54) AMOLED PIXEL DRIVING CIRCUIT AND DRIVING METHOD THEREOF

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Shan Wang, Guangdong (CN); Yichien Wen, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 102 days.

(21) Appl. No.: 15/742,659

(22) PCT Filed: Dec. 4, 2017

(86) PCT No.: PCT/CN2017/114495

§ 371 (c)(1),
(2) Date: Jan. 8, 2018

(87) PCT Pub. No.: WO2019/095451

PCT Pub. Date: May 23, 2019

(65) Prior Publication Data

US 2019/0156749 A1 May 23, 2019

(30) Foreign Application Priority Data

Nov. 17, 2017 (CN) ..... 2017 1 1147331

(51) Int. Cl.
*G09G 3/3258* (2016.01)

(52) U.S. Cl.
CPC ... *G09G 3/3258* (2013.01); *G09G 2300/0819* (2013.01); *G09G 2320/0233* (2013.01); *G09G 2320/045* (2013.01)

(58) Field of Classification Search
CPC combination set(s) only.
See application file for complete search history.

(56) References Cited

U.S. PATENT DOCUMENTS

2014/0132162 A1* 5/2014 Kim ..... G09G 3/3266 315/161
2016/0071458 A1* 3/2016 Tan ..... G09G 3/3233 345/212
2016/0232836 A1* 8/2016 Yang ..... G09G 3/3233

FOREIGN PATENT DOCUMENTS

CN 105304020 A 2/2016
CN 106297662 A 1/2017
(Continued)

*Primary Examiner* — Temesghen Ghebretinsae
*Assistant Examiner* — Sosina Abebe
(74) *Attorney, Agent, or Firm* — Hemisphere Law, PLLC; Zhigang Ma

(57) ABSTRACT

The present application provides an AMOLED pixel driving circuit and a driving method thereof. The AMOLED pixel driving circuit employs a 6T1C pixel driving circuit with a specific driving timing to effectively compensate the threshold voltage to drive the thin film transistors and stabilize the current flowing through the OLED, to ensure uniform luminance of organic light emitting diodes and improve the display effect of the image. Meanwhile, the combination of the N-type thin film transistor and the P-type thin film transistor to reduce the number of the thin film transistors and the scan control signals to simplify the structure of the pixel driving circuit and increase the luminous area.

14 Claims, 9 Drawing Sheets

(56) References Cited

FOREIGN PATENT DOCUMENTS

| | | | |
|---|---|---|---|
| CN | 106782322 | A | 5/2017 |
| CN | 106847179 | A | 6/2017 |
| CN | 107301842 | A | 10/2017 |
| KR | 10-2013-0009487 | A | 1/2013 |
| KR | 10-2015-0071366 | A | 6/2015 |

* cited by examiner

AMOLED PIXEL DRIVING CIRCUIT AND DRIVING METHOD THEREOF

RELATED APPLICATIONS

The present application is a National Phase of International Application Number PCT/CN2017/114495, filed on Dec. 4, 2017, and claims the priority of China Application 201711147331.8 filed on Nov. 17, 2017.

FIELD OF THE DISCLOSURE

The disclosure relates to a display technical field, and more particularly to an AMOLED pixel driving circuit and driving method thereof.

BACKGROUND

Organic Light Emitting Display (OLEO) display device with self-luminous, low driving voltage, high luminous efficiency, short response time, high resolution and contrast, nearly 180° viewing angle, wide using temperature range, to achieve flexible display and large area panchromatic display and many other advantages, is recognized as the industry's most promising display device.

OLEDs can be classified into passive matrix OLEDs, PMOLEDs and active matrix OLEDs, AMOLEDs according to driving modes, namely, direct addressing and thin film transistor matrix addressing two categories. Wherein, AMOLED has a matrix arrangement of pixels, belonging to the active display type, high luminous efficiency, usually used for high resolution large-size display device.

AMOLED is a current-driven device. When a current flows through the organic light emitting diode, the organic light emitting diode emits light, and the emitting luminance is determined by the current flowing through the organic light emitting diode itself. Most existing integrated circuits (ICs) only transmit voltage signals, so AMOLEDs pixel driving circuit needs to complete the task of converting voltage signals into current signals. Conventional AMOLED pixel driver circuit is usually 2T1C, that is, two thin-film transistors and a capacitor structure, the voltage is converted to current. As the threshold voltage to drive the thin film transistor shifts, the current flowing through the organic light emitting diode changes greatly, resulting in the unstable emitting of the organic light emitting diode, and the luminance is very uneven, greatly affecting the display effect of the image. To solve the above problem, a compensation circuit needs to be added to each pixel. The compensation means that the threshold voltage to drive the thin film transistor in each pixel must be compensated, so that the current flowing through the organic light emitting diode becomes independent of the threshold voltage.

As shown in FIG. 1, a 7T2C AMOLED pixel driving circuit includes seven thin film transistors and two capacitors, and are respectively a first thin film transistor T10, a second thin film transistor T20, a third thin film transistor T30, a fourth thin film transistor T40, a fifth thin film transistor T50, a sixth thin film transistor T60, a seventh thin film transistor T70, a first capacitor C10, and a second capacitor C20. The pixel driving circuit needs to be controlled by four scan control signals, respectively are a first scan control signal S10, a second scan control signal S20, a third scan control signal S30, and a fourth scan control signal S40. An operation timing diagram of the circuit is as shown in FIG. 2, the operation process of the circuit includes: a first phase 10, a second phase 20, and a third phase 30, wherein in the second phase 20, a low potential is provided after a high potential, the second scan control signal S20 first provides a high voltage and then a low voltage. When the second scan control signal S20 provides a low voltage, by the function of the first capacitor C1, causing the potential of the connection point of the first capacitor C1 and the second capacitor C2 is unstable, and the pixel driving circuit needs seven thin film transistors and two capacitors, the structure is complex, the effective light emitting area of the pixel is low, and the number of scan control signals is large, so that the timing controller is also relatively complex.

SUMMARY

An object of the present application is to provide an AMOLED pixel driving circuit capable of effectively compensating a threshold voltage to drive thin film transistors, to ensure a uniform light emitting luminance of the organic light emitting diode, and simplifying the structure of the pixel driving circuit, to increase the effective light emitting area.

Another object of the present application is to provide driving method of the AMOLED pixel capable of effectively compensate the threshold voltage to drive thin film transistors, stabilize the current flowing through the organic light emitting diode, ensure uniform light emitting luminance of the organic light emitting diode, and improve the display effect of the image.

In order to achieve the above objects, the present application provides an AMOLED pixel driving circuit, including: a first thin film transistor, a second thin film transistor, a third thin film transistor, a fourth thin film transistor, a fifth thin film transistor, a sixth thin film transistor, a capacitor and an organic light emitting diode;

A gate of the first thin film transistor connected to a second scan control signal, a source of the first thin film transistor electrically connected to a data signal, and a drain of the first thin film transistor electrically connected to a first node;

A gate of the second thin film transistor connected to the third scan control signal, a source of the second thin film transistor electrically connected to the first node, and a drain of the second thin film transistor electrically connected to a second node;

A gate of the third thin film transistor connected to a first scan control signal, a source of the third thin film transistor electrically connected to the second node, and a drain of the third thin film transistor electrically connected to a third node;

A gate of the fourth thin film transistor connected to the third scan control signal, a source of the fourth thin film transistor electrically connected to the third node, and a drain of the fourth thin film transistor electrically connected to an anode of the organic light emitting diode;

A gate of the fifth thin film transistor connected to the third scan control signal, a source of the fifth thin film transistor connected to a reference voltage, and a drain of the fifth thin film transistor electrically connected to the second node;

A gate of the sixth thin film transistor electrically connected to the first node, a drain of the sixth thin film transistor connected to a high voltage, and a source of the sixth thin film transistor electrically connected to the third node;

One end of the capacitor electrically connected to the second node, and the other end of the capacitor electrically connected to the third node;

A cathode of the organic light emitting diode connected to a power supply low voltage; and Wherein the fifth thin film transistor is one of an n-type thin film transistor and a p-type thin film transistor, the first, second, third, fourth and sixth thin film transistors are one of the n-type thin film transistors and the p-type thin film transistors different from the fifth thin film transistor.

The first scan control signal, the second scan control signal, and the third scan control signal are combined, successively correspond to a data voltage storage phase, a threshold voltage compensation phase, and a display emission phase, respectively, and control the organic light emitting diode not to emit light during the data voltage storage phase and the threshold voltage compensation phase.

During the data voltage storage phase, the first scan control signal provides a first potential, the second scan control signal provides the first potential, the third scan control signal provides a second potential different from the first potential, the first thin film transistor, the third thin film transistor and the fifth thin film transistor are turned on, the second thin film transistor and the fourth thin film transistor are turned off;

During the threshold voltage compensation phase, the first scan control signal provides the second potential, and the second scan control signal first provides the first potential and then provides the second potential, the third scan control signal provides the second potential, the fifth thin film transistor is turned on, the second thin film transistor, the third thin film transistor, and the fourth thin film transistor are turned off, and the first thin film transistor is first turned on and then turned off;

During the display emission phase, the first scan control signal provides the second potential, the second scan control signal provides the second potential, and the third scan control signal provides the first potential, the second thin film transistor and the fourth thin film transistor are turned on, the first thin film transistor, the third thin film transistor and the fifth thin film transistor are turned off.

The fifth thin film transistor is a p-type thin film transistor, and the first, second, third, fourth and sixth thin film transistors are n-type thin film transistor.

The first potential is a high potential, and the second potential is a low potential.

The fifth thin transistor is an n-type thin film transistor, and the first, second, third, fourth and sixth thin film transistors are p-type thin film transistor.

The first potential is a low potential, and the second potential is a high potential.

The first scan control signal, the second scan control signal, and the third scan control signal are all provided by an external timing controller.

Each of the first thin film transistor, the second thin film transistor, the third thin film transistor, the fourth thin film transistor, the fifth thin film transistor and the sixth thin film transistor is a low-temperature polysilicon thin film transistor, an oxide semiconductor thin film transistor, or amorphous silicon thin film transistor.

The present application further provides a driving method for an AMOLED pixel A driving method for an AMOLED pixel applied to the AMOLED pixel driving circuit, including the following steps:

Step s001, entering a data voltage storage phase;

Providing a first potential by a first scan control signal, providing the first potential by a second scan control signal, providing a second potential different from the first potential by a third scan control signal, turning on a first thin film transistor, a third thin film transistor and a fifth thin film transistor, turning off a second thin film transistor and a fourth thin film transistor, writing a data signal into a first node, writing a reference voltage into a second node and a third node;

Step s002, entering a threshold voltage compensation phase;

Providing the second potential by the first scan control signal, providing the first potential by the second scan control signal, providing the second potential by the third scan control signal, turning on the fifth thin film transistor, turning off the second thin film transistor, the third thin film transistor and the fourth thin film transistor, and first turning on then turning off the first thin film transistor;

Wherein when the second scan control signal is at the first potential, the third node discharges through the sixth thin film transistor to makes the potential of the third node becoming Vdata−Vth, wherein Vdata is a voltage of the data signal, Vth is a threshold voltage of the sixth thin film transistor;

Wherein when the second scan control signal is at the second voltage, a voltage of the first node becomes zero, a voltage of the second node is maintained at a reference voltage, a voltage of the third node is maintained at Vdata−Vth;

Step s003, entering a display emission phase;

Providing the second potential by the first scan control signal, providing the second potential by the second scan control signal, providing the first potential by the third scan control signal, turning on the second thin film transistor and the fourth thin film transistor, turning off the first thin film transistor, the third thin film transistor, and the fifth thin film transistor, and emitting light by an organic light emitting diode.

The present application further provides an AMOLED pixel driving circuit, including: a first thin film transistor, a second thin film transistor, a third thin film transistor, a fourth thin film transistor, a fifth thin film transistor, a sixth thin film transistor, a capacitor, and an organic light emitting diode;

A gate of the first thin film transistor connected to a second scan control signal, a source of the first thin film transistor electrically connected to a data signal, and a drain of the first thin film transistor electrically connected to a first node;

A gate of the second thin film transistor connected to a third scan control signal, a source of the second thin film transistor electrically connected to the first node, and a drain of the second thin film transistor electrically connected to a second node;

A gate of the third thin film transistor connected to a first scan control signal, a source of the third thin film transistor electrically connected to the second node, and a drain of the third thin film transistor electrically connected to a third node;

A gate of the fourth thin film transistor connected to the third scan control signal, a source of the fourth thin film transistor electrically connected to the third node, and a drain of the fourth thin film transistor electrically connected to an anode of the organic light emitting diode;

A gate of the fifth thin film transistor connected to a third scan control signal, a source of the fifth thin film transistor connected to a reference voltage, and a drain of the fifth thin film transistor electrically connected to the second node;

A gate of the sixth thin film transistor electrically connected to the first node, a drain of the sixth thin film transistor connected to a high voltage, and a source of the sixth thin film transistor electrically connected to the third node;

One end of the capacitor electrically connected to the second node, and the other end of the capacitor electrically connected to the third node;

A cathode of the organic light emitting diode connected to a power supply low voltage;

Wherein the fifth thin film transistor is one of an n-type thin film transistor and a p-type thin film transistor, the first, second, third, fourth and sixth thin film transistors are one of the n-type thin film transistors and the p-type thin film transistors different from the fifth thin film transistor;

Wherein the first scan control signal, the second scan control signal, and the third scan control signal are combined, successively correspond to a data voltage storage phase, a threshold voltage compensation phase, and a display emission phase, respectively, and control the organic light emitting diode not to emit light during the data voltage storage phase and the threshold voltage compensation phase;

Wherein during the data voltage storage phase, the first scan control signal provides a first potential, the second scan control signal provides the first potential, the third scan control signal provides a second potential different from the first potential, the first thin film transistor, the third thin film transistor and the fifth thin film transistor are turned on, the second thin film transistor and the fourth thin film transistor are turned off;

Wherein during the threshold voltage compensation phase, the first scan control signal provides the second potential, and the second scan control signal first provides the first potential and then provides the second potential, the third scan control signal provides the second potential, the fifth thin film transistor is turned on, the second thin film transistor, the third thin film transistor, and the fourth thin film transistor are turned off, and the first thin film transistor is first turned on and then turned off;

Wherein during the display emission phase, the first scan control signal provides the second potential, the second scan control signal provides the second potential, and the third scan control signal provides the first potential, the second thin film transistor and the fourth thin film transistor are turned on, the first thin film transistor, the third thin film transistor and the fifth thin film transistor are turned off;

Wherein the first scan control signal, the second scan control signal, and the third scan control signal are all provided by an external timing controller; and Wherein each of the first thin film transistor, the second thin film transistor, the third thin film transistor, the fourth thin film transistor, the fifth thin film transistor and the sixth thin film transistor is a low-temperature polysilicon thin film transistor, an oxide semiconductor thin film transistor, or amorphous silicon thin film transistor.

Advantageous effects of application: the present application provides an AMOLED pixel driving circuit adopting a pixel driving circuit of a 6t1c structure and with a specific driver timing to effectively compensate the threshold voltage to drive the thin film transistors, so that the current flowing through the organic light emitting diode is stable, to ensure the uniformity of emission luminance of the organic light emitting diode, and the display effect of the image is improved. Meanwhile, by the arrangement of the N-type thin film transistor and the P-type thin film transistor, to reduce the number of thin film transistors and scan control signals, so as to simplify the structure of the pixel driving circuit and increase the effective light emitting area. The present application also provides a driving method for an AMOLED pixel capable of effectively compensate the threshold voltage to drive the thin film transistors, stabilize the current flowing through the organic light emitting diode, ensure uniform light emitting luminance of the organic light emitting diode, and improve the display effect of the image.

BRIEF DESCRIPTION OF THE DRAWINGS

The technical solutions of the present application and other beneficial effects will be apparent from the following detailed description of specific embodiments of the present application with reference to the accompanying drawings.

In the drawings.

DETAILED DESCRIPTION OF PREFERRED EMBODIMENTS

To further illustrate the technical means adopted by the present application and the effects thereof, the following describes in detail the preferred embodiments of the present application and the accompanying drawings.

Figure 1:
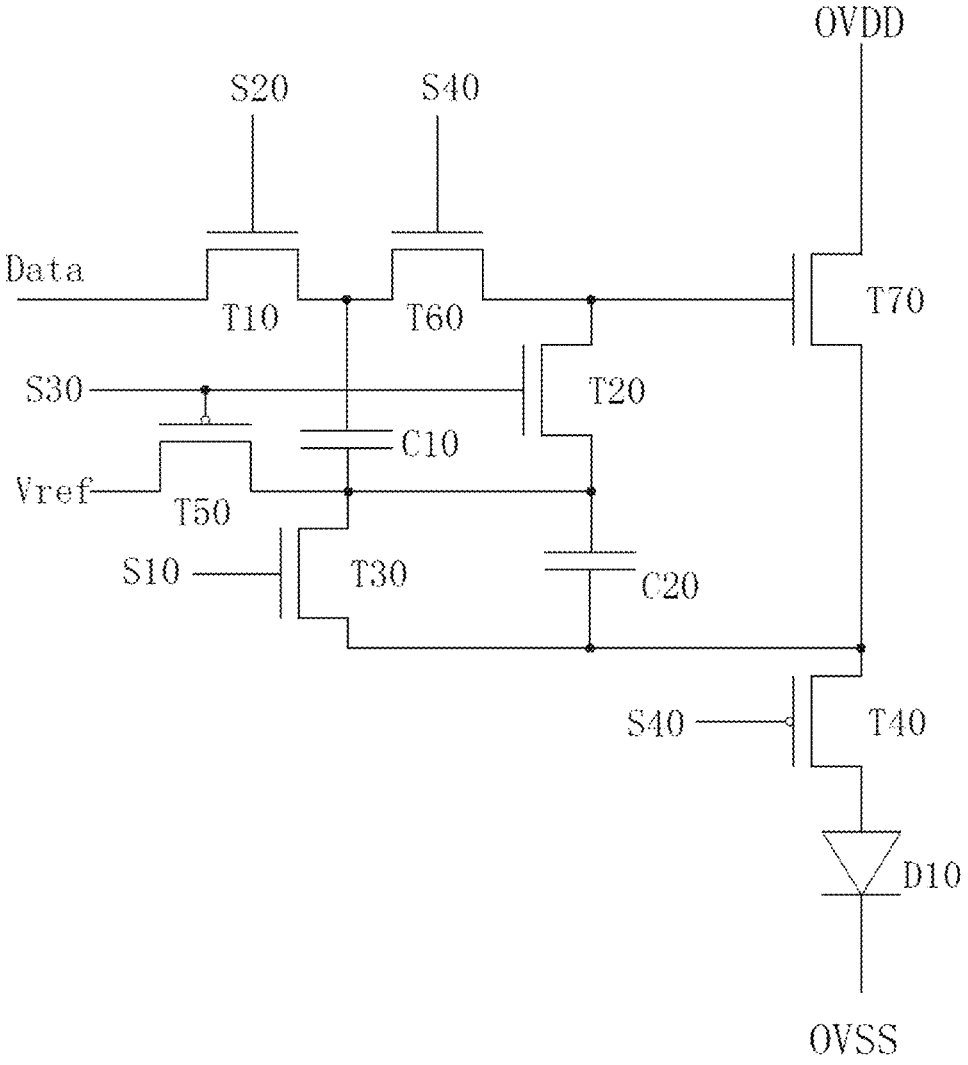
FIG. 1 (Prior Art)
FIG. 1 is a circuit diagram of a conventional AMOLED pixel driving circuit.
Figure 2:
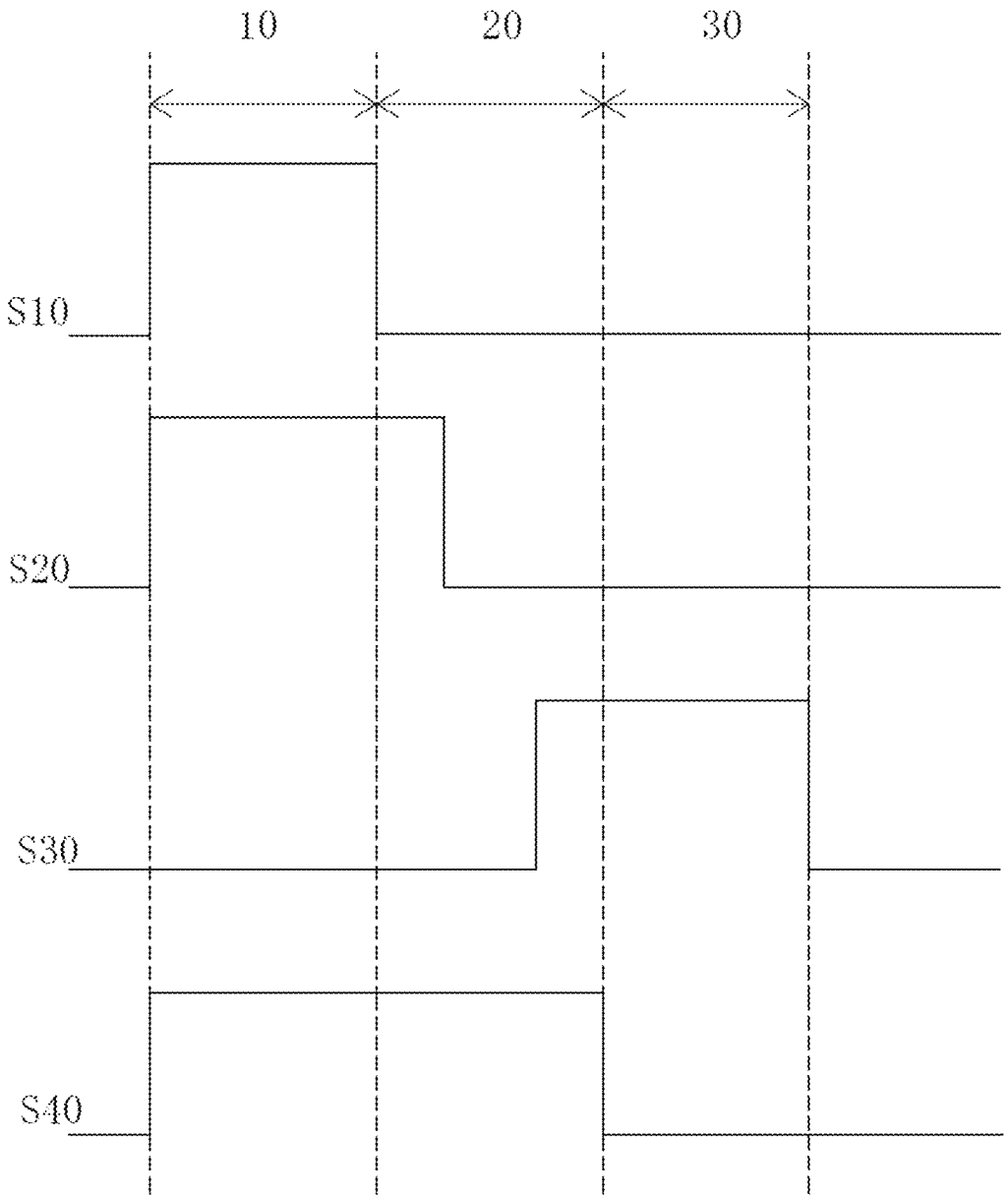
FIG. 2 (Prior Art)
FIG. 2 is a timing diagram of the AMOLED pixel driving circuit shown in FIG. 1.
Figure 3:
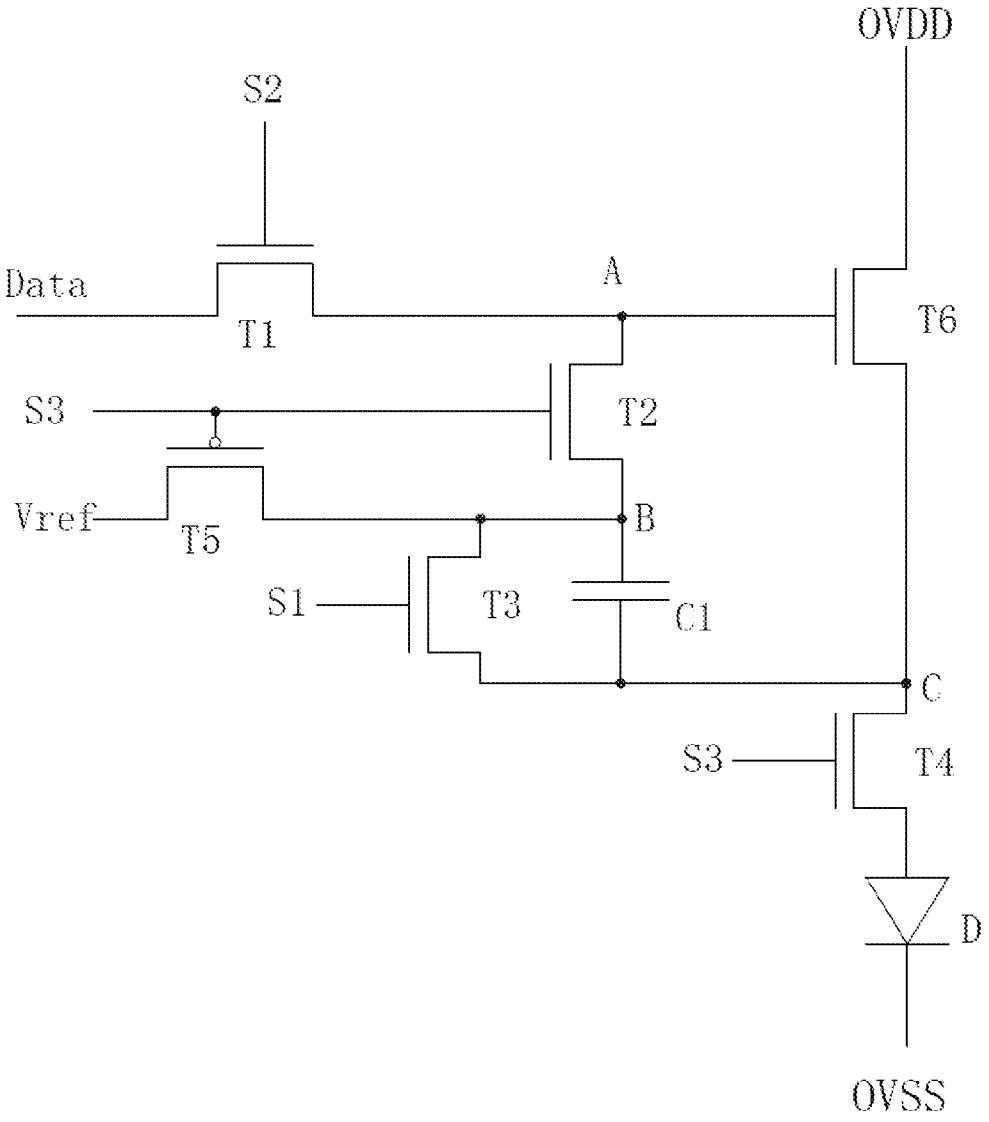
FIG. 3 is a circuit diagram of the AMOLED pixel driving circuit of the present application.

Referring to FIG. 3, the present application provides an AMOLED pixel driving circuit includes: a first thin film transistor T1, a second thin film transistor T2, a third thin film transistor T3, a fourth thin film transistor T4, a fifth thin film transistor T5 and a sixth thin film transistor T6, a capacitor C1, and an organic light emitting diode D.

A gate of the first thin film transistor T1 is connected to a second scan control signal S2, a source of the first thin film transistor T1 is electrically connected to the data signal Data, and a drain of the first thin film transistor T1 is electrically connected to a first node A;

A gate of the second thin film transistor T2 is connected to a third scan control signal S3, a source of the second thin film transistor T2 is electrically connected to the first node A, and a drain of the second thin film transistor T2 is electrically connected to a second node B;

A gate of the third thin film transistor T3 is connected to a first scan control signal S1, a source of the third thin film transistor T3 is electrically connected to the second node B, and a drain of the third thin film transistor T3 is electrically connected to a third node C;

A gate of the fourth thin film transistor T4 is connected to the third scan control signal S3, a source of the fourth thin film transistor T4 is electrically connected to the third node C, and a drain of the fourth thin film transistor T4 is electrically connected to an anode of the organic light emitting diode D;

A gate of the fifth thin film transistor T5 is connected to the third scan control signal S3, a source of the fifth thin film transistor T5 is connected to a reference voltage Vref, and a drain of the fifth thin film transistor T5 is electrically connected to the second node B;

A gate of the sixth thin film transistor T6 is electrically connected to the first node A, a drain of the sixth thin film transistor T6 is connected to a high voltage OVDD, and a source of the sixth thin film transistor T6 is electrically connected to the third node C;

One end of the capacitor C1 is electrically connected to the second node B, and the other end of the capacitor C1 is electrically connected to the third node C;

A cathode of the organic light emitting diode D is connected to a power supply low voltage OVSS.

The fifth thin film transistor T5 is one of an N-type thin film transistor and a P-type thin film transistor. The first, second, third, fourth and sixth thin film transistors T1, T2, T3, T4, T6 are one of the N-type thin film transistor and the P-type thin film transistor different from the fifth thin film transistor T5.

Figure 4:
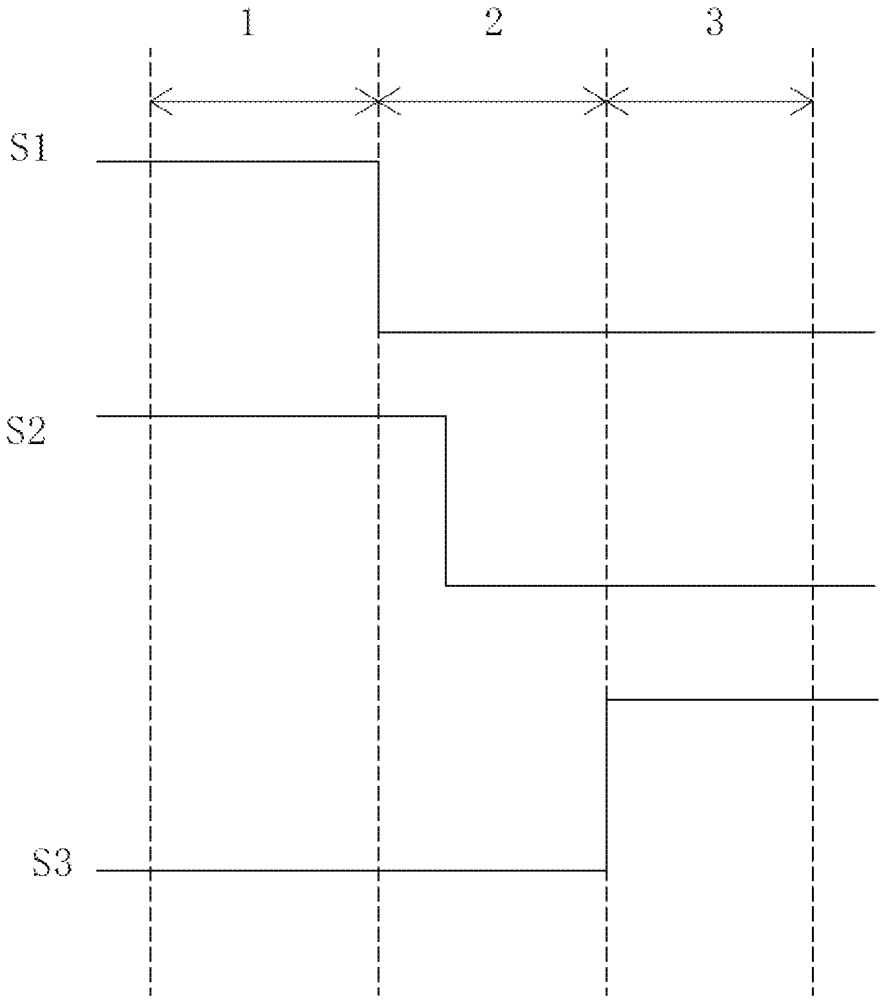
FIG. 4 is a timing diagram of the AMOLED pixel driving circuit of the present application.

Specifically, as shown in FIG. 4, the operation process of the AMOLED pixel driving circuit of the present application is combining the first scan control signal S1, the second scan control signal S2, and the third scan control signal S3, and successively correspond to a data voltage storage phase 1, a threshold voltage compensation phase 2, and a display emission phase 3, respectively, and control the organic light emitting diode D not to emit light during the data voltage storage phase 1 and the threshold voltage compensation phase 2.

Figure 5:
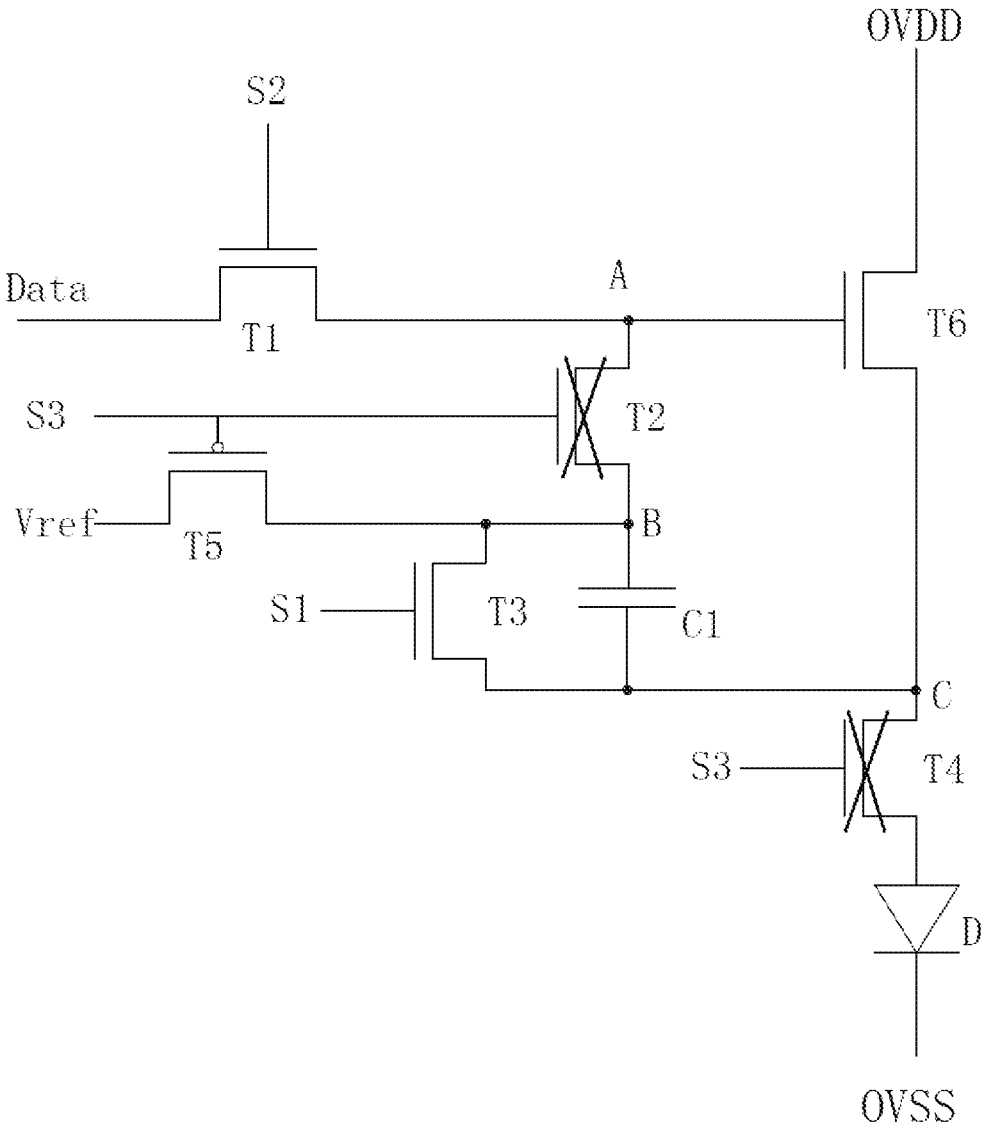
FIG. 5 is a schematic diagram of step S001 of the AMOLED pixel driving method of the present application.
Figure 6:
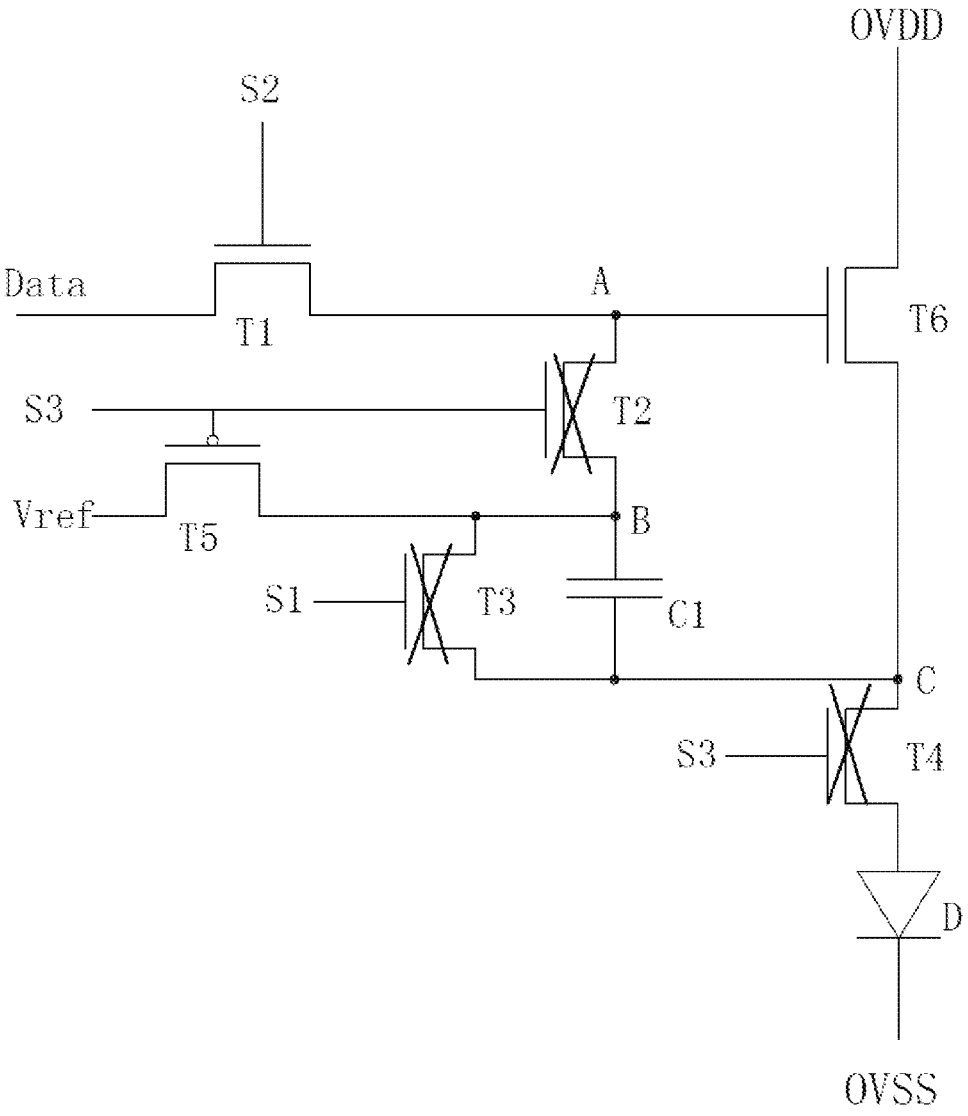
FIGS. 6-7 are schematic diagrams of step S002 of the AMOLED pixel driving method of the present application.
Figure 7:
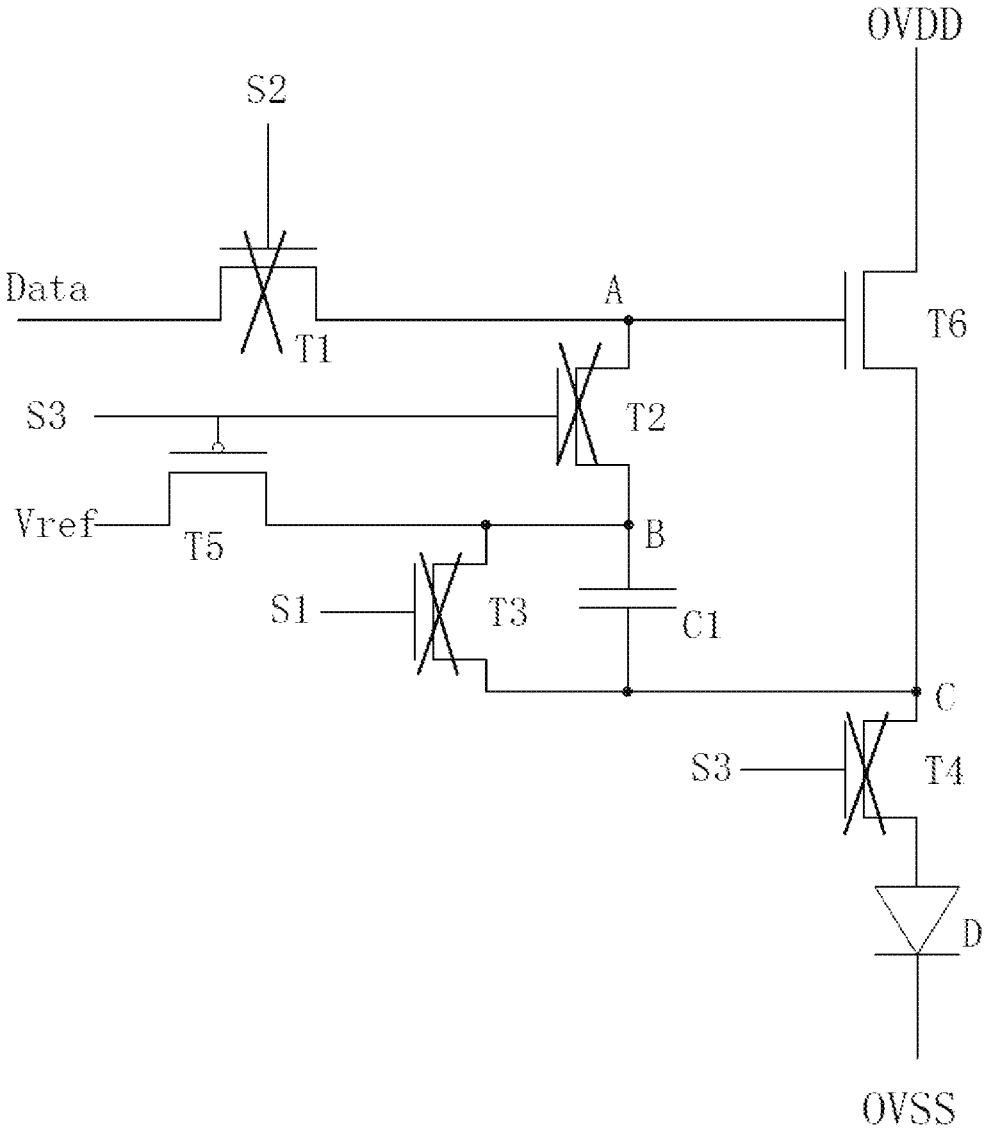

Wherein, as shown in FIG. 5, during the data voltage storage phase 1, the first scan control signal S1 provides a first potential, the second scan control signal S2 provides the first potential, the third scan control signal S3 provides a second potential different from the first potential, the first thin film transistor T1, the third thin film transistor T3 and the fifth thin film transistor T5 are turned on, the second thin film transistor T2 and the fourth thin film transistor T4 are turned off, and the data signal Data is written into the first node A, the reference voltage Vref is written into the second node B and the third node C, the voltage of the first node A is equal to the voltage Vdata of the data signal, the voltages of the second node B and the third node C are equal to the reference voltage Vref;

Further, as shown in FIG. 6 and FIG. 7, during the threshold voltage compensation phase 2, the first scan control signal S1 provides the second potential, and the second scan control signal S2 first provides the first potential and then provides the second potential, the third scan control signal S3 provides the second potential, the fifth thin film transistor T5 is turned on, the second thin film transistor T2, the third thin film transistor T3, and the fourth thin film transistor T4 are turned off, and the first thin film transistor T1 is first turned on and then turned off.

Figure 8:
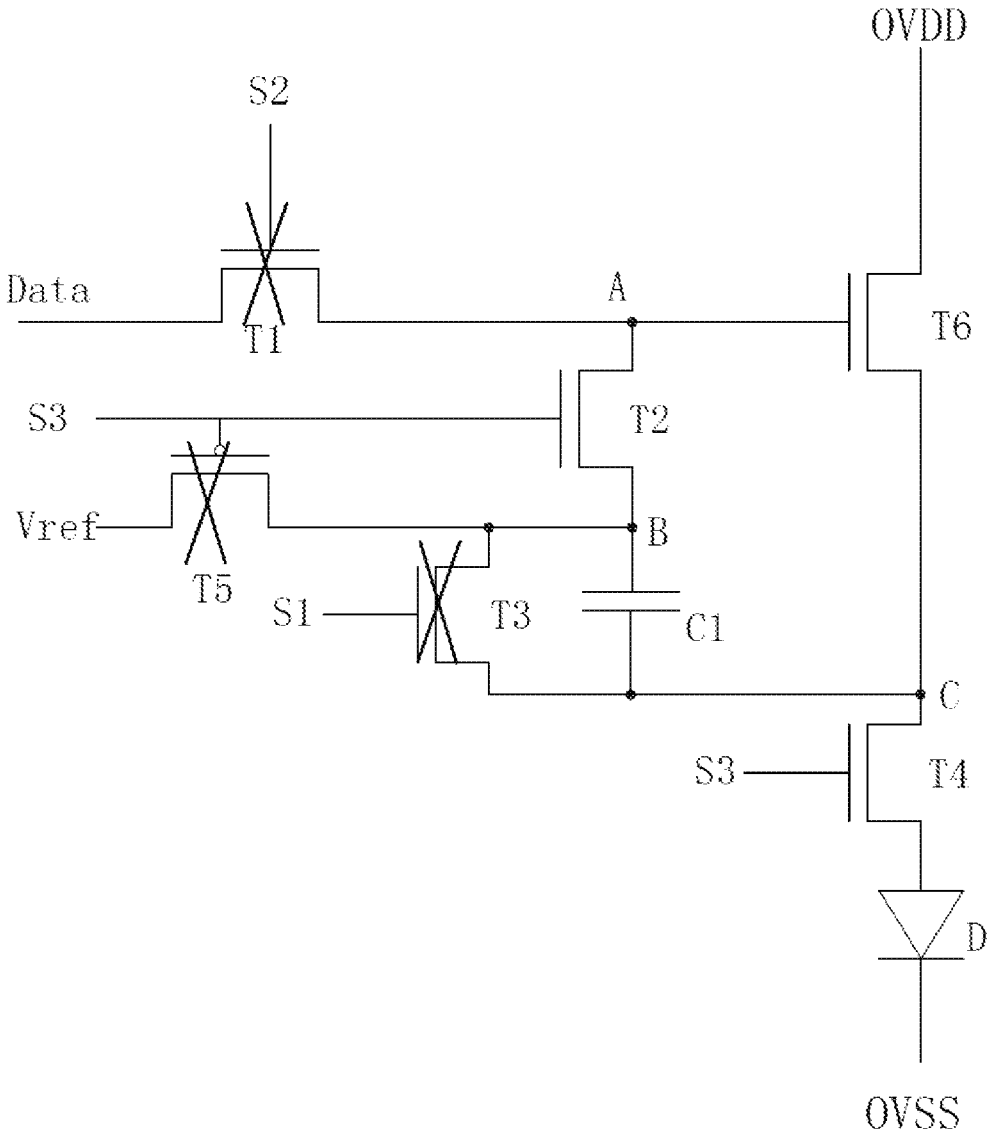
FIG. 8 is a schematic diagram of step S003 of the AMOLED pixel driving method of the present application.

In detail, as shown in FIG. 6, when the second scan control signal S2 is at the first potential, the third node C is discharged through the sixth thin film transistor T6, until the sixth thin film transistor T6 is turned off, so that the voltage of the third node C is changed to be Vdata−Vth, the voltage difference across the capacitor C1 is Vref−(Vdata−Vth), wherein Vdata is the voltage of the data signal Data, Vth is the threshold voltage of the sixth thin film transistor T6, the voltage of the first node A is maintained at the voltage of the data signal Vdata, the voltage of the second node B is maintained at the reference voltage Vref; as shown in FIG. 7, when the second scan control signal S2 is at the second potential, the voltage of the first node A changes to zero, because the voltage difference of the capacitor C1 is not changed, the voltage of the second node B is maintained at the reference voltage Vref, the voltage of the third node C is maintained at Vdata−Vth;

Further, as shown in FIG. 8, during the display emission phase 3, the first scan control signal S1 provides the second potential, the second scan control signal S2 provides the second potential, and the third scan control signal S3 provides the first potential, the second thin film transistor T2 and the fourth thin film transistor T4 are turned on, the first thin film transistor T1, the third thin film transistor T3 and the fifth thin film transistor T5 are turned off, the organic light emitting diode D emits light, a current baled flows through the organic light emitting diode D is equal to $loled=k(Vgs-Vth)^2=k(Vref-Vdata+Vth-Vth)^2=k(Vref-Vdata)^2$, wherein k is the structural parameter for driving the thin film transistor, that is the structural parameter of the sixth thin film transistor T6, Vgs is the gate-source voltage difference of the sixth thin film transistor T6. For the thin film transistor of the same structure, the K value is relatively stable, so that the current flowing through the organic light emitting diode D when the organic light emitting diode D emits light is independent from the threshold voltage of the sixth thin film transistor T6, to solve the problem that the unstable current flowing through the organic light emitting diode caused by the shifting of the threshold voltage to drive the thin film transistor, making the light emitting luminance of the organic light emitting diode is uniform, and to improve the display effect of the image.

Preferably, in the first embodiment of the present application, the fifth thin film transistor T5 is a P-type thin film transistor, and the first, second, third, fourth and sixth thin film transistors T1, T2, T3, T4, T6 are N-type thin film transistor. The first potential is a high potential, and the second potential is a low potential.

Preferably, in the second embodiment of the present application, the fifth thin film transistor T5 is an N-type thin film transistor, and the first, second, third, fourth and sixth thin film transistors T1, T2, T3, T4, T6 are P-type thin film transistor. The first potential is a low potential, and the second potential is a high potential.

Specifically, the first scan control signal S1, the second scan control signal S2, and the third scan control signal S3 are all provided by an external timing controller.

Specifically, each of the first thin film transistor T1, the second thin film transistor T2, the third thin film transistor T3, the fourth thin film transistor T4, the fifth thin film transistor T5 and the sixth thin film transistor T6 is a low-temperature polysilicon thin film transistor, an oxide semiconductor thin film transistor, or amorphous silicon thin film transistor.

Figure 9:
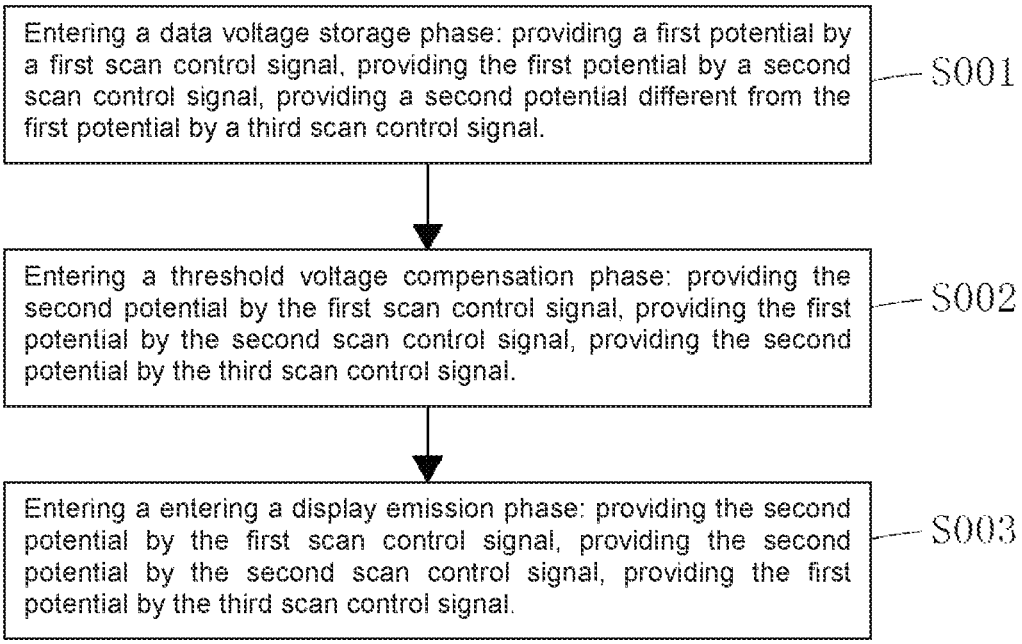
FIG. 9 is a flowchart of the AMOLED pixel driving method of the present application.

Referring to FIG. 9, a driving method for an AMOLED pixel according to the present application is applied to the AMOLED pixel driving circuit above, and includes the following steps:

Step S001, referring to FIG. 5, entering a data voltage storage phase 1;

Providing a first potential by a first scan control signal S1, providing the first potential by a second scan control signal S2, providing a second potential different from the first potential by a third scan control signal S3, turning on a first thin film transistor T1, a third thin film transistor T3 and a fifth thin film transistor T5, turning off a second thin film transistor T2 and a fourth thin film transistor T4, writing a data signal Data into a first node A, writing a reference voltage Vref into a second node B and a Third node C.

Specifically, in step S001 the voltage of the first node A is equal to the voltage Vdata of the data signal, and the voltages of the second node B and the third node C are equal to the reference voltage Vref.

Step S002, referring to FIGS. 6 to 7, in the threshold voltage compensation phase 2;

Providing the second potential by the first scan control signal S1, providing the first potential by the second scan control signal S2, providing the second potential by the third scan control signal S3, turning on the fifth thin film transistor T5, turning off the second thin film transistor T2, the third thin film transistor T3 and the fourth thin film transistor T4, and first turning on then turning off the first thin film transistor T1.

Specifically, in step S002, when the second scan control signal S2 is at the first potential, the third node C discharges through the sixth thin film transistor T6 until the sixth thin film transistor T6 is turned off, so that the potential of the third node C becomes Vdata−Vth, the voltage difference of the capacitor C1 is Vref−(Vdata−Vth), wherein Vdata is the voltage of the data signal Data, Vth is the threshold voltage of the sixth thin film transistor T6; the voltage of the first node A is maintained at the voltage of the data signal Vdata, the voltage of the second node B is maintained at the reference voltage Vref.

Further, in step S002, when the second scan control signal S2 is at the second voltage, the voltage of the first node A becomes zero. Since the voltage difference of the capacitor C1 is not changed, the voltage of the second node B is maintained at the reference voltage Vref, the voltage of the third node C is maintained at Vdata−Vth.

Step S003, referring to FIG. 8, entering a display emission phase 3;

Providing the second potential by the first scan control signal S1, providing the second potential by the second scan control signal S2, providing the first potential by the third scan control signal S3, turning on the second thin film transistor T2 and the fourth thin film transistor T4, turning off the first thin film transistor T1, the third thin film transistor T3, and the fifth thin film transistor T5, and emitting light by the organic light emitting diode D.

Specifically, in step S003, the current loled flowing through the organic light emitting diode D is equal to $loled=k(Vgs-Vth)^2=k(Vref-Vdata+Vth-Vth)^2=k(Vref-Vdata)^2$, wherein, wherein k is the structural parameter for driving the thin film transistor, that is the structural parameter of the sixth thin film transistor T6, Vgs is the gate-source voltage difference of the sixth thin film transistor T6. For the thin film transistor of the same structure, the K value is relatively stable, so that the current flowing through the organic light emitting diode D when the organic light emitting diode D emits light is independent from the threshold voltage of the sixth thin film transistor T6, to solve the problem that the unstable current flowing through the organic light emitting diode caused by the shifting of the threshold voltage to drive the thin film transistor, making the light emitting luminance of the organic light emitting diode is uniform, and to improve the display effect of the image.

In summary, the present application provides an AMOLED pixel driving circuit adopting a pixel driving circuit of a 6T1C structure and with a specific driver timing to effectively compensate the threshold voltage to drive the thin film transistors, so that the current flowing through the organic light emitting diode is stable, to ensure the uniformity of emission luminance of the organic light emitting diode, and the display effect of the image is improved. Meanwhile, by the arrangement of the N-type thin film transistors and the P-type thin film transistors, to reduce the number of thin film transistors and scan control signals, so as to simplify the structure of the pixel driving circuit, and increase the effective light emitting area. The present application also provides a driving method for the AMOLED pixel, capable of effectively compensate the threshold voltage to drive the thin film transistors, stabilize the current flowing through the organic light emitting diode, ensure uniform light emitting luminance of the organic light emitting diode, and improve the display effect of the image.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. An AMOLED pixel driving circuit, comprising:

a first thin film transistor; a second thin film transistor, a third thin film transistor, a fourth thin film transistor, a fifth thin film transistor, a sixth thin film transistor, a capacitor, and an organic light emitting diode;

a gate of the first thin film transistor connected to a second scan control signal, a source of the first thin film transistor electrically connected to a data signal, and a drain of the first thin film transistor electrically connected to a first node;

a gate of the second thin film transistor connected to the third scan control signal, a source of the second thin film transistor electrically connected to the first node, and a drain of the second thin film transistor electrically connected to a second node;

a gate of the third thin film transistor connected to a first scan control signal, a source of the third thin film transistor electrically connected to the second node, and a drain of the third thin film transistor electrically connected to a third node;

a gate of the fourth thin film transistor connected to the third scan control signal, a source of the fourth thin film transistor electrically connected to the third node, and a drain of the fourth thin film transistor electrically connected to an anode of the organic light emitting diode;

a gate of the fifth thin film transistor connected to the third scan control signal, a source of the fifth thin film transistor connected to a reference voltage, and a drain of the fifth thin film transistor electrically connected to the second node;

a gate of the sixth thin film transistor electrically connected to the first node, a drain of the sixth thin film transistor connected to a high voltage, and a source of the sixth thin film transistor electrically connected to the third node;

one end of the capacitor electrically connected to the second node, and the other end of the capacitor electrically connected to the third node;

a cathode of the organic light emitting diode connected to a power supply low voltage;

wherein the fifth thin film transistor is one of an N-type thin film transistor and a P-type thin film transistor, the first, second, third, fourth and sixth thin film transistors are one of the N-type thin film transistors and the P-type thin film transistors different from the fifth thin film transistor;

wherein the first scan control signal, the second scan control signal, and the third scan control signal are combined, successively correspond to a data voltage storage phase, a threshold voltage compensation phase, and a display emission phase, respectively, and control the organic light emitting diode not to emit light during the data voltage storage phase and the threshold voltage compensation phase; and during the data voltage storage phase, the first scan control signal provides a first potential, the second scan control signal provides the first potential, the third scan control signal provides a second potential different from the first potential, the first thin film transistor, the third thin film transistor and the fifth thin film transistor are turned on, the second thin film transistor and the fourth thin film transistor are turned off;

during the threshold voltage compensation phase, the first scan control signal provides the second potential, and the second scan control signal first provides the first potential and then provides the second potential, the third scan control signal provides the second potential, the fifth thin film transistor is turned on, the second thin film transistor, the third thin film transistor, and the fourth thin film transistor are turned off, and the first thin film transistor is first turned on and then turned off; and during the display emission phase, the first scan control signal provides the second potential, the second scan control signal provides the second potential, and the third scan control signal provides the first potential, the second thin film transistor and the fourth thin film transistor are turned on, the first thin film transistor, the third thin film transistor and the fifth thin film transistor are turned off.

2. The AMOLED pixel driving circuit according to claim 1, wherein the fifth thin film transistor is a P-type thin film transistor; and the first, second; third, fourth and sixth thin film transistors are N-type thin film transistor.

3. The AMOLED pixel driving circuit according to claim 2, wherein the first potential is a high potential, and the second potential is a low potential.

4. The AMOLED pixel driving circuit according to claim 1, wherein the fifth thin transistor is an N-type thin film transistor, and the first, second, third, fourth and sixth thin film transistors are P-type thin film transistor.

5. The AMOLED pixel driving circuit according to claim 4, wherein the first potential is a low potential, and the second potential is a high potential.

6. The AMOLED pixel driving circuit according to claim 1, wherein the first scan control signal, the second scan control signal, and the third scan control signal are all provided by an external timing controller.

7. The AMOLED pixel driving circuit according to claim 1, wherein each of the first thin film transistor, the second thin film transistor, the third thin film transistor, the fourth thin film transistor, the fifth thin film transistor and the sixth thin film transistor is a low-temperature polysilicon thin film transistor, an oxide semiconductor thin film transistor, or amorphous silicon thin film transistor.

8. The AMOLED pixel driving circuit according to claim 1, wherein during the data voltage storage phase a data signal is further written into a first node; and a reference voltage is written into a second node and a third node.

9. The AMOLED pixel driving circuit according to claim 1, wherein during the threshold voltage compensation phase, when the second scan control signal is at the first potential, the third node discharges through the sixth thin film transistor to makes the potential of the third node becoming Vdata−Nth, wherein Vdata is a voltage of the data signal, Vth is a threshold voltage of the sixth thin film transistor; and wherein when the second scan control signal is at the second voltage, a voltage of the first node becomes zero, a voltage of the second node is maintained at a reference voltage, a voltage of the third node is maintained at Vdata−Vth.

10. An AMOLED pixel driving circuit, comprising:

a first thin film transistor, a second thin film transistor, a third thin film transistor, a fourth thin film transistor, a fifth thin film transistor, a sixth thin film transistor, a capacitor; and an organic light emitting diode;

a gate of the first thin film transistor connected to a second scan control signal, a source of the first thin film transistor electrically connected to a data signal; and a drain of the first thin film transistor electrically connected to a first node;

a gate of the second thin film transistor connected to a third scan control signal, a source of the second thin film transistor electrically connected to the first node, and a drain of the second thin film transistor electrically connected to a second node;

a gate of the third thin film transistor connected to a first scan control signal, a source of the third thin film transistor electrically connected to the second node, and a drain of the third thin film transistor electrically connected to a third node;

a gate of the fourth thin film transistor connected to the third scan control signal, a source of the fourth thin film transistor electrically connected to the third node, and a drain of the fourth thin film transistor electrically connected to an anode of the organic light emitting diode;

a gate of the fifth thin film transistor connected to a third scan control signal, a source of the fifth thin film transistor connected to a reference voltage, and a drain of the fifth thin film transistor electrically connected to the second node;

a gate of the sixth thin film transistor electrically connected to the first node, a drain of the sixth thin film transistor connected to a high voltage, and a source of the sixth thin film transistor electrically connected to the third node;

one end of the capacitor electrically connected to the second node, and the other end of the capacitor electrically connected to the third node;

a cathode of the organic light emitting diode connected to a power supply low voltage;

wherein the fifth thin film transistor is one of an N-type thin film transistor and a P-type thin film transistor, the first, second, third, fourth and sixth thin film transistors are one of the N-type thin film transistors and the P-type thin film transistors different from the fifth thin film transistor;

wherein the first scan control signal, the second scan control signal, and the third scan control signal are combined, successively correspond to a data voltage storage phase, a threshold voltage compensation phase, and a display emission phase, respectively, and control the organic light emitting diode not to emit light during the data voltage storage phase and the threshold voltage compensation phase;

wherein during the data voltage storage phase, the first scan control signal provides a first potential, the second scan control signal provides the first potential, the third scan control signal provides a second potential different from the first potential, the first thin film transistor, the third thin film transistor and the fifth thin film transistor are turned on, the second thin film transistor and the fourth thin film transistor are turned off;

wherein during the threshold voltage compensation phase, the first scan control signal provides the second potential, and the second scan control signal first provides the first potential and then provides the second potential, the third scan control signal provides the second potential, the fifth thin film transistor is turned on, the second thin film transistor, the third thin film transistor, and the fourth thin film transistor are turned off, and the first thin film transistor is first turned on and then turned off;

wherein during the display emission phase, the first scan control signal provides the second potential, the second scan control signal provides the second potential, and the third scan control signal provides the first potential, the second thin film transistor and the fourth thin film transistor are turned on, the first thin film transistor, the third thin film transistor and the fifth thin film transistor are turned off;

wherein the first scan control signal, the second scan control signal, and the third scan control signal are all provided by an external timing controller; and wherein each of the first thin film transistor, the second thin film transistor, the third thin film transistor, the fourth thin film transistor, the fifth thin film transistor and the sixth thin film transistor is a low-temperature polysilicon thin film transistor, an oxide semiconductor thin film transistor, or amorphous silicon thin film transistor.

11. The AMOLED pixel driving circuit according to claim 10, wherein the fifth thin film transistor is a P-type thin film transistor, and the first, second, third, fourth and sixth thin film transistors are N-type thin film transistor.

12. The AMOLED pixel driving circuit according to claim 11, wherein the first potential is a high potential, and the second potential is a low potential.

13. The AMOLED pixel driving circuit according to claim 10, wherein the fifth thin transistor is an N-type thin film transistor, and the first, second, third, fourth and sixth thin film transistors are P-type thin film transistor.

14. The AMOLED pixel driving circuit according to claim 13, wherein the first potential is a low potential, and the second potential is a high potential.

* * * * *